US005416997A

United States Patent [19]

Dyment et al.

[11] Patent Number: 5,416,997

[45] Date of Patent: May 23, 1995

[54] COLLAPSIBLE DISPLAY

[75] Inventors: James A. Dyment; Phillip M. Batsch; David K. Downey, all of Cincinnati, Ohio

[73] Assignee: Dyment Ltd., Canada

[21] Appl. No.: 98,950

[22] Filed: Jul. 28, 1993

[51] Int. Cl.[6] ..... G09F 15/00

[52] U.S. Cl. ..... 40/610; 40/473

[58] Field of Search ..... 40/607, 610, 612, 584, 40/539, 473; 493/136, 138, 309, 311

[56] References Cited

U.S. PATENT DOCUMENTS

| | | | |
|---|---|---|---|
| 1,545,771 | 7/1925 | Hout | 40/539 X |
| 1,548,237 | 8/1925 | Ackermann | 40/539 X |
| 1,576,672 | 3/1926 | Miller | 40/539 X |
| 1,638,035 | 8/1927 | Hulbert | 493/136 X |
| 3,031,784 | 5/1962 | Stein | 40/473 |
| 3,654,716 | 4/1972 | Moss | 40/473 |
| 4,991,335 | 2/1991 | Krautsack | 40/539 X |
| 5,054,219 | 10/1991 | Hoyt et al. | 40/473 |

FOREIGN PATENT DOCUMENTS

| | | | |
|---|---|---|---|
| 696391 | 8/1953 | United Kingdom | 40/539 |

*Primary Examiner*—Kenneth J. Dorner

*Assistant Examiner*—Joanne Silbermann

*Attorney, Agent, or Firm*—Wood, Herron & Evans

[57] ABSTRACT

An advertising display is convertible between an expanded display configuration and a collapsed configuration for storage and transportation. The display includes a cylindrical tube with generally circular end walls attached to the inner surface of the tube adjacent the top and bottom edges thereof. A center post is secured at a top end to the center of the top end wall and projects through the tube to extend therefrom through a center hole in the bottom end wall. The expanded display is rotatable about the tube by an electric motor mounted within the tube and coupled to the top end wall. The motor is powered by batteries also positioned within the post. The tube has diametrically opposed longitudinal fold lines extending between the top and bottom edges thereof to permit it to be collapsed to a storage and transportation configuration when not in use. Parallel transverse fold lines on each circular end wall enables them to fold inwardly within the tube when it is collapsed. Furthermore, holes within each end wall permit the post of another similarly collapsed display to be inserted therethrough to nest the collapsed displays of the present invention for more compact and convenient storage or transportation.

16 Claims, 2 Drawing Sheets

COLLAPSIBLE DISPLAY

FIELD OF THE INVENTION

The present invention relates to an advertising display, and more particularly, to a rotating advertising display which is collapsible and capable of nesting with other similar displays when not in use.

BACKGROUND OF THE INVENTION

The retail merchandising of consumer products is often a very highly competitive field. The merchandising scheme and advertising efforts for a successful consumer product are frequently the reason it generates more sales than other comparable products.

A common tool in the merchandising and advertising of consumer products is a point of sale display at the retail store where the product is purchased by the consumer. The ability to distinguish one brand from competing brands and gain the purchaser's attention is the ultimate goal of advertising. Point of sale displays enable a particular brand or product to be distinguished from other comparable products also available at the same store or retail outlet.

Specifically, beverages such as juices, soft drinks, and beer are often sold in individual or multi-pack cans or bottles at grocery, convenience, and other retail stores. Multiple competing brands of bottles or cans of beverages are commonly displayed side-by-side at the store. Because the beverage industry is highly competitive, one way for manufacturers, bottlers, and distributors to gain an advantage is by attracting the consumer or purchaser's attention to their particular brand at the point of sale.

For these reasons, point of sales displays are effective as a marketing and advertising tool to differentiate one brand from a competing brand. The point of sale displays are commonly enlarged replicas of the bottle, can, or package of the particular brand including its identifiable design, color scheme, or logo. For example, an enlarged paperboard cylinder decorated with a particular brand's bottle or can design is often found in the grocery or convenience store aisle where the competing beverages are stocked and displayed. The consumer's attention is drawn toward the display which is a replica of that particular brand's bottle or can found on the nearby shelf thereby gaining a competitive marketing advantage over the other brands.

However, store managers have found that the advertising displays of the type previously described are bulky and when not in use inconvenient for both storage and transportation. Furthermore, because the advertising displays are bulky enlarged cylinders, they are subject to an increased likelihood of damage thereby detracting from their appearance, useful life, and effectiveness as an advertising and marketing tool.

The advertising displays by design are large in order to attract the attention of the consumer. Such an advertising display can be as large as four feet in height and two feet in diameter for a replica cylindrical beverage can display. The display is typically constructed of a relatively inexpensive paperboard and includes a minimal amount of internal support structure because its effectiveness as an advertising tool is determined by its outward appearance and not its structural integrity.

Problems arise, however, because of the size of the display when it is transported from the manufacturer or distributer to the store, from location to location within the store, or from store to store. The displays require careful handling and packaging because they include little or no internal structural support to withstand damaging loads imparted to the display during transportation and storage.

Because the advertising displays of the type described are bulky and require specialized handling to avoid damage, they are often avoided or insufficiently utilized by the store manager who may be unwilling to devote the required effort to protect and use the advertising display.

As evidenced by the above background, the use of enlarged point of sale advertising displays has been curtailed due to the inherent drawbacks of such displays; namely, their bulk, size, and specialized storage and transportation requirements. However, when used the advertising displays have proven to be a beneficial component of the advertising and marketing plans for consumer products. Therefore, a need exists for an advertising display which is effective in attracting the consumer's attention at the point of sale and can be both transported and stored without special handling to avoid damage to the display.

SUMMARY OF THE INVENTION

This invention is directed to an improved advertising display which can be collapsed to a more compact configuration for easy handling, storage, and transportation. In the collapsed configuration, the advertising display can be nested with other similarly collapsed displays for the more compact storage and transportation of a plurality of advertising displays. Furthermore, the advertising display of this invention rotates in use to thereby provide a more attractive and appealing display which is more likely to gain the attention of the consumer. In achieving these qualities, the improved advertising display is more effective as an advertising and marketing tool and is more conveniently stored and transported when not in use and therefore more likely to be used by the store manager.

The advertising display of this invention includes a tube which has an advertising design or logo affixed to the outer surface of its circumferential side wall. In a display configuration, the tube is expanded to a generally cylindrical configuration. To convert the tube to a collapsed configuration, pressure is applied inwardly toward the center of the tube approximately equal distance between a pair of diametrically opposed longitudinal fold lines extending the height of the tube.

Affixed to an inner surface of the tube at both the top and bottom edges thereof is an end wall. Each end wall is generally circular with diametrically opposed tabs projecting from its circumference. The tabs are glued to the inner surface of the tube midway between the tube longitudinal fold lines. A pair of transverse parallel fold lines are spaced apart along a center line of each circular end wall. The transverse fold lines enable the end wall to be folded inwardly toward the interior of the collapsed cylindrical tube.

In order to secure each end wall in the display configuration, a strip of single face corrugated material is affixed adjacent each of the top and bottom edges on the inner surface of the tube. The strip extends substantially around the circumference of the tube. Tabs are spaced from the strip and also affixed to the inner surface of the tube. When expanded to the display configuration, the outer circumferential edge of each circular end wall is frictionally retained in the gap between the strip and the tab on the inner surface of each end of the tube. Therefore, the circular end wall with the transverse fold lines will not deflect toward the interior of the tube until such time as the tube is to be collapsed into the storage configuration.

A cylindrical post is mounted concentrically within the tube. A top end of the post is secured to the center of the top end wall between the transverse fold lines. The post is longer than the tube and projects from the bottom of the tube through a hole in the center of the bottom end wall. When the tube is converted from the display configuration to the storage configuration, the bottom end wall collapses inwardly toward the center of the tube and the post slides freely through the hole in the bottom end wall. The top end wall likewise collapses toward the interior of the tube as the attached post moves downwardly further through the bottom of the tube.

Additional holes are provided between the transverse fold lines on each end wall and are adapted to receive therethrough the post of a second display in the collapsed storage configuration according to this invention. The post of a first display is inserted through the holes in each end wall of a second display and the post of a second display is inserted through the holes in each end wall of the first display. The nesting of the collapsed displays in this manner provides for more convenient and compact advertising displays.

The display of this invention also includes a motor mounted within the top end of the post. The motor rotates the tube about the post thereby enhancing the display's consumer appeal and attractiveness. The motor within the post has a rotating drive shaft which is coupled to the top end wall of the display. Batteries are provided within the post to supply the required energy to the motor.

The display can be conveniently mounted for rotation and use either to a generally upright display panel as with a mounting bracket or as a floor display with a pole and pole feet. An upper end of the pole mates with the the lower end of the post and the combination is supported on the floor by the pole feet extending from the lower end of the pole.

The above features and advantages of the present invention will be better understood in reference to the accompanying figures and detailed description. It should also be understood that the specific materials, configurations, geometric relationships, and mechanisms of this invention are exemplary only and are not to be regarded as limitations of the invention.

BRIEF DESCRIPTION OF THE DRAWINGS

Reference is now made to the accompanying figures from which the novel features and advantages of the present invention will be apparent.

DETAILED DESCRIPTION OF THE INVENTION

By way of illustrating and providing a more complete appreciation of the present invention and many of the attendant advantages thereof, the following detailed description is given concerning the novel features of an advertising display of the present invention.

Figure 1:
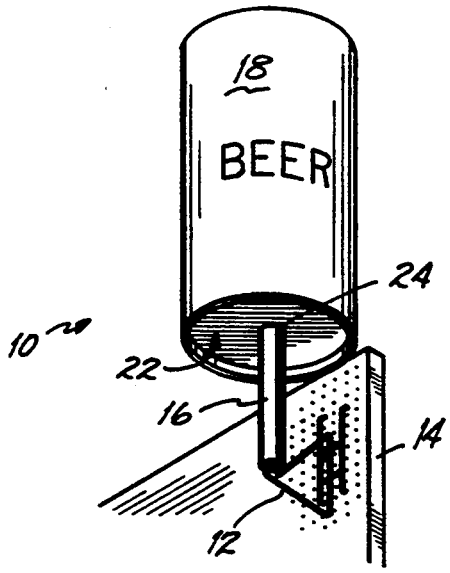
FIG. 1 is a perspective view of an advertising display of the present invention mounted to a wall.

A preferred embodiment of the present invention is shown in FIG. 1 as an advertising display 10. The advertising display 10 is mounted upon a support bracket 12 which is attached to a perforate wall 14. It will be appreciated by one of ordinary skill in the art that the advertising display of this invention can be supported or attached to other walls or structures in other ways or supported on the floor of a grocery or retail store with an appropriately designed support bracket.

The support bracket 12 is attached to the bottom end of a cylindrical post 16 projecting from a larger generally cylindrical tube 18. An outer surface of the tube 18 has an advertising design, logo, or other appropriate graphic illustration thereon.

The display 10 can also be conveniently mounted for rotation and use as a floor display with a pole and pole feet (not shown). An upper end of the pole mates with the the lower end of the post 16 and the combination is supported on the floor by the pole feet extending from the lower end of the pole.

Figure 2:
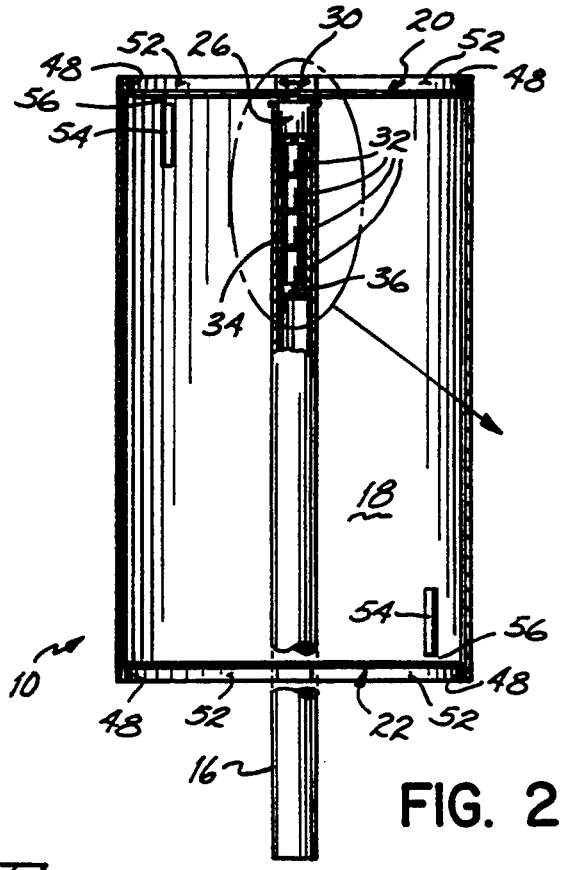
FIG. 2 is a cross-sectional view of the display in an expanded display configuration.

The advertising display 10 of FIG. 1 is shown in an expanded display configuration and includes generally planar and circular top and bottom end walls 20, 22 attached proximate the bottom and top edges, respectively, of the tube 18 (FIG. 2). A top end of the post 16 is secured to the center of the top end wall 20 and the post 16 projects out from the bottom of the tube 18 through a center hole 24 in the bottom end wall 22.

Figure 2A:
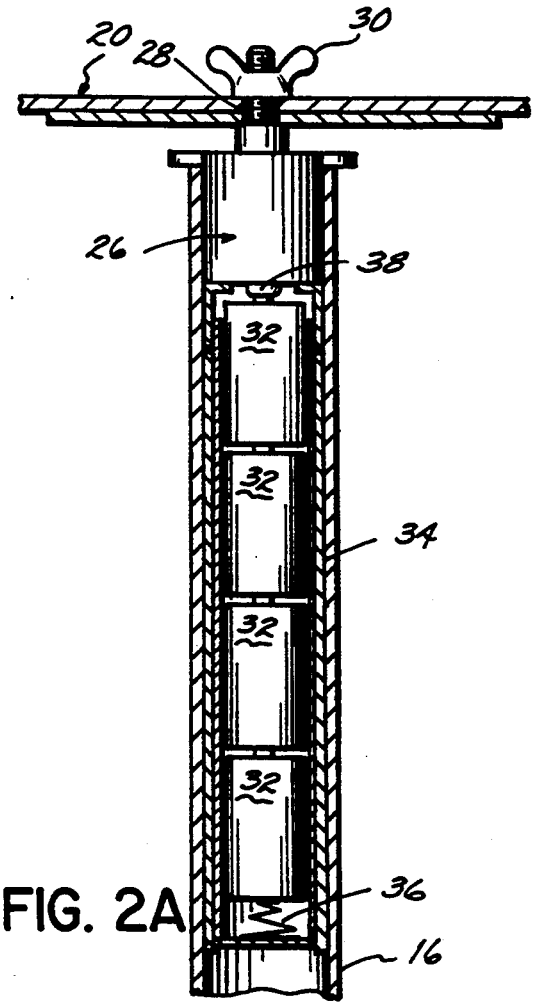
FIG. 2A is an enlarged cross-sectional view of region 2A of FIG. 2 showing a motor and batteries mounted within a post of the invention.

As shown in FIGS. 2 and 2A, a motor 26 is secured within the top end of the post 16 and has a rotary drive shaft 28 projecting upwardly through the center of the top end wall 20. The drive shaft 28 is threaded to receive a wing nut 30 securing the drive shaft 28 to the top end wall 20. When the motor 26 rotates the drive shaft 28, the display 10 is rotated about the center post 16 because the top end wall 20 is secured to the drive shaft 28. The motor 26 is powered by batteries 32 serially aligned in end-to-end contact and concentrically contained within a battery housing 34 in the top end of the post 16. The battery housing 34 includes a spiral spring 36 at the bottom end thereof to maintain the end-to-end terminal contact between the batteries 32 and a motor terminal 38. In the preferred embodiment of this invention, four D-size batteries are used to power the motor 26. It will be appreciated by one of ordinary skill in the art that other mechanisms could be used to rotate the display without deviating from the scope of this invention.

Figure 3:
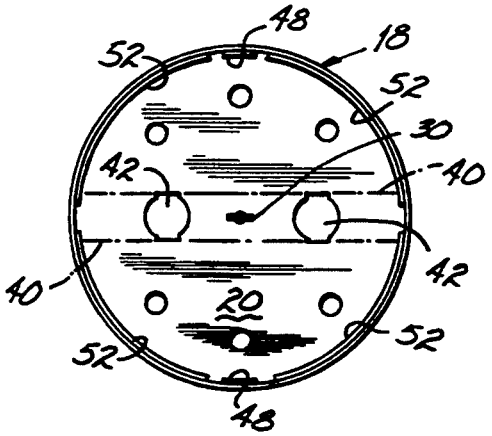
FIG. 3 is a top view of the display in the expanded display configuration.

As shown in FIG. 3, the circular top end wall 20 of the display 10 in the expanded configuration is generally planar and has a pair of parallel transverse fold lines 40 spaced apart along a center line of the end wall 20. Likewise, the bottom end wall 22 also has a pair of parallel transverse fold lines 40. A nesting hole 42 is provided between the transverse fold lines 40 on each side of the center of each end wall 20, 22. The purpose for nesting holes 42 is described later in this disclosure. Other holes 44 are also provided in the end walls 20, 22 for the convenient handling and conversion of the display 10 between the expanded display configuration and the collapsed storage configuration. The holes 44 are easily grasped to aid in the conversion and handling of the display 10.

Figure 4:
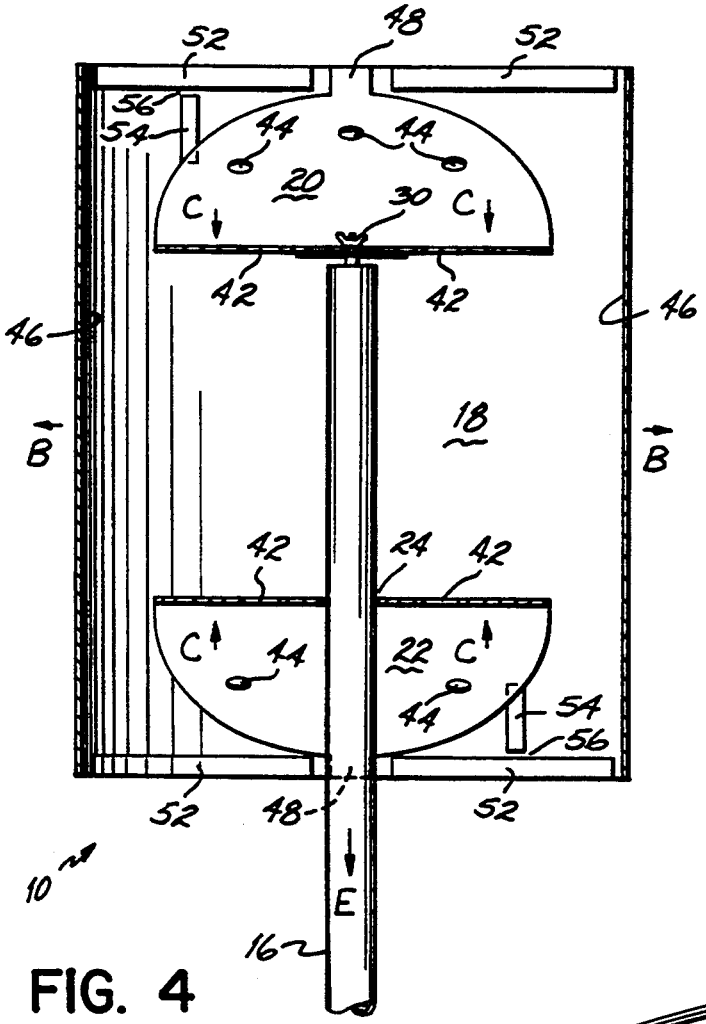
FIG. 4 is a cross-sectional plan view of the display partially collapsed to a storage configuration.
Figure 5:
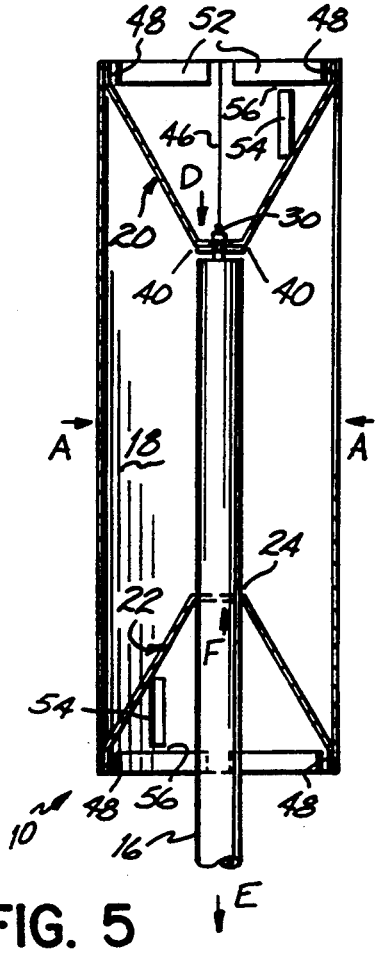
FIG. 5 is a cross-sectional side view of the display of FIG. 4.
Figure 6:
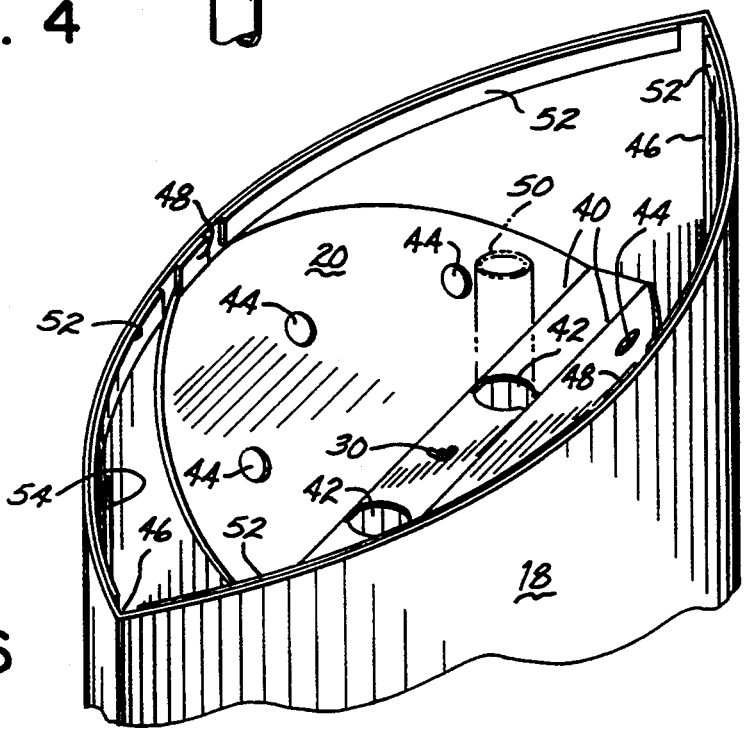
FIG. 6 is a partial perspective view of the display with the post of a second similar display inserted through holes in the end walls of the display.

The tube 18 has a pair longitudinal diametrically opposed fold lines 46 extending between the top and bottom edge as shown in FIGS. 4–6. The longitudinal fold lines 46 enable the tube 18 to be collapsed into the storage configuration.

A pair of tongues 48 project from the outer circumferential edge of each end wall 20, 22 to attach the end walls to the tube 18. The tongues 48 are diametrically opposed along a center line perpendicular to the transverse fold lines 40. Each tongue 48 is secured by adhesive or other suitable attachment mechanism to the inner surface of the tube 18 adjacent the respective top and bottom edges thereof.

To convert the display 10 from the expanded display configuration to the collapsed storage configuration, inward pressure is applied to the tube 18 as shown by arrows A in FIG. 5 at diametrically opposed locations generally midway between the longitudinal fold lines 46. As pressure is applied in the direction of arrows A, the longitudinal fold lines 46 collapse the tube 18 in the direction of arrows B of FIG. 4. In association with the collapse of the tube 18, the top and bottom end walls 20, 22 fold inwardly toward the interior of the tube 18 along the transverse fold lines 40 as shown by arrows C in FIG. 4. The collapse of the top end wall 20 pushes the post 16 secured thereto downward in the direction of arrow D to thereby extend further out of the bottom of the tube 18 in the direction of arrow E. As the tube 18 collapses and the end walls 20, 22 fold inwardly, the bottom end wall 22 translates upwardly along the post 16 in the direction of arrow F. The display 10 of the present invention is collapsed in this manner to achieve the storage configuration shown in FIGS. 4–6.

Once in the collapsed storage configuration, the display 10 can be nested with other similarly collapsed displays as shown in FIG. 6. The collapsed displays 10 are nested by inserting a post 50 of a second display through the corresponding nesting holes 42 in the top and bottom end walls 20, 22 of the first display 10. Likewise, the post 16 of the first collapsed display 10 is inserted through corresponding nesting holes in the top and bottom end walls of the second collapsed display (not shown). As a result, the collapsed displays are nested for more convenient and compact storage and transportation.

In the expanded display configuration, the tube 18 is generally cylindrical and the circular top and bottom end walls 20, 22 are generally planar. To secure the top and bottom end walls 20, 22 in the generally planar configuration, strips 52 are secured by adhesive or another appropriate fastener to the inner surface of the tube 18 between the end wall tongue 48 and the longitudinal fold line 46 adjacent each edge of the tube 18 as shown in FIGS. 2, 4, and 6. Also secured to the inner surface of the tube 18 are tabs 54. The tabs 54 are spaced from the strips 52 away from the respective edges of the tube 18 to define a gap 56 therebetween into which the outer circumferential edge of the end wall 20, 22 is retained. As the tube 18 is expanded from the collapsed storage configuration, the end walls 20, 22 unfold outwardly toward the respective top and bottom edges of the tube 18. As the end wall 20, 22 unfolds, the circumferential edge approaches the inner surface of the expanding tube 18 and frictionally slides over the tabs 54 to seat within the gap 56 between the tabs and the strips 52 thereby releasably securing the planar end walls 20, 22 in the expanded display configuration.

In the preferred embodiment of this invention, the tube 18, both end walls 20, 22, and the post 16 are each constructed of paperboard or reinforced fiberboard. The tabs 54 and strips 52 affixed to the inner surface of the tube 18 are preferably constructed of corrugated paperboard. It will be appreciated by one of ordinary skill in the art that the various components of the present invention can be constructed of other materials including but not limited to plastic, corrugated plastic board, or other laminate materials without deviating from the scope of this invention.

From the above disclosure of the general principals of the present invention and the preceding detailed description of the preferred embodiment, those skilled in the art will readily comprehend the various modifications to which the present invention is susceptible. Therefore, we desire to be limited only by the scope of the following claims and equivalents thereof.

We claim:

1. An advertising display comprising:

a collapsible tube having a top edge, a bottom edge, and an inner surface:

a pair of end walls, one of which is attached near said top edge and the other of which is attached near said bottom edge of said tube:

said tube having a plurality of fold lines enabling said tube to be selectively converted between an expanded display configuration and a collapsed storage configuration;

each said end wall having a fold line enabling said end wall to be collapsed when said tube is in said storage configuration and to be expanded when said tube is in said display configuration: and means for releasably securing each said end wall in said display configuration, said securing means comprising a strip affixed to said inner surface of said tube proximate said edge of said tube and a tab affixed to said inner surface of said tube and spaced from said strip to define a gap therebetween, an edge of said expanded end wall being frictionally retained in said gap between said strip and said tab thereby securing said expanded end wall in said display configuration.

2. The display of claim 1 wherein said collapsible tube is cylindrical and each said end wall is circular.

3. The display of claim 2 wherein said tube has a pair of diametrically opposed fold lines extending between said top and bottom edges of said cylindrical tube.

4. The display of claim 2 wherein each said end wall has a transverse fold line proximate a center region of said circular end wall.

5. The display of claim 1 wherein said tube and each said end wall is constructed of paper board.

6. The display of claim 1 further comprising:

a support post mounted within said tube and having an end secured to one of said end walls: and means in said post for rotating said tube about said post.

7. The display of claim 6 wherein said rotating means comprises a motor mounted in a section of the post which is inside said tube, said motor having a rotating shaft being coupled to said end wall secured to said post, and means for powering said motor.

8. The display of claim 6 further comprising:

means for nesting a plurality of similar displays in said storage configuration, said nesting means comprising a hole in at least one of said end walls of the display, said hole adapted to receive therethrough said post of another display.

9. An advertising display comprising:

a collapsible tube having a too edge, a bottom edge, and an inner surface;.

a pair of end walls, one of which is attached near said top edge and the other of which is attached near said and bottom edge of said tube:

a support post mounted within said tube, said post having an end secured to one of said end walls and extending beyond one of said end walls:

said tube having a plurality of fold lines enabling said tube to be selectively converted between an expanded display configuration and a collapsed storage configuration;

each said end wall having a plurality of fold lines enabling said end will to be collapsed when said tube is in said storage configuration and to be expanded when said tube is in said .display configuration; and means for releasably securing each said end wall in said display configuration;

said securing means comprises a strip affixed to said inner surface of said tube proximate said edge of said tube and a tab affixed to said inner surface of said tube and spaced from said strip to define a gap therebetween, an edge of said expanded end wall being frictionally retained in said gap between said strip and said tab thereby securing said expanded end wall in said display configuration.

10. The display of claim 9 wherein said tube is cylindrical, each said end wall is circular, and said post is attached at a center of one of said circular end walls.

11. The display of claim 10 wherein said tube has a pair of diametrically opposed fold lines extending between said top and bottom edges of said cylindrical collapsible tube.

12. The display of claim 10 wherein each said end wall has a pair of generally parallel transverse fold lines spaced apart proximate a center region of said circular end wall.

13. The display of claim 9 wherein said tube and each said end wall is constructed of paper board.

14. The display of claim 9 further comprising:

means for nesting a plurality of similar displays in said storage configuration, said nesting means comprising a hole in at least one of said end walls of the display, said hole adapted to receive therethrough said post of another display.

15. The display of claim 9 further comprising:

means in said post for rotating said tube about said post.

16. The display of claim 15 wherein said rotating means comprises a motor mounted in a section of the post which is inside said tube, said motor having a rotating shaft being coupled to said end wall secured to said post, and means for powering said motor.

* * * * *